US010106299B2

(12) United States Patent
Luizzi et al.

(10) Patent No.: US 10,106,299 B2
(45) Date of Patent: Oct. 23, 2018

(54) FOOD CONTAINER AND METHOD

(71) Applicant: LUIZZI BROS. SEALCOATING & STRIPING LLC, Albany, NY (US)

(72) Inventors: Bryant Luizzi, Loudonville, NY (US); Christian Luizzi, Loudonville, NY (US); Peter Luizzi, Loudonville, NY (US)

(73) Assignee: LUIZZI BROS. SEALCOATING & STRIPING LLC, Albany, NY (US)

( * ) Notice: Subject to any disclaimer, the term of this patent is extended or adjusted under 35 U.S.C. 154(b) by 191 days.

(21) Appl. No.: 14/588,047

(22) Filed: Dec. 31, 2014

(65) Prior Publication Data

US 2015/0183559 A1 Jul. 2, 2015

Related U.S. Application Data

(63) Continuation of application No. 14/587,992, filed on Dec. 31, 2014.

(60) Provisional application No. 61/922,515, filed on Dec. 31, 2013.

(51) Int. Cl.

| | |
|---|---|
| ***B65D 5/06*** | (2006.01) |
| ***B65D 77/06*** | (2006.01) |
| ***B65D 33/25*** | (2006.01) |
| ***B65D 47/06*** | (2006.01) |
| ***B65B 7/02*** | (2006.01) |
| ***B65B 61/00*** | (2006.01) |
| ***B65D 47/12*** | (2006.01) |
| ***B65D 77/30*** | (2006.01) |
| ***B65B 61/18*** | (2006.01) |
| ***B65B 1/02*** | (2006.01) |

(52) U.S. Cl.

CPC ..... *B65D 47/066* (2013.01); *B65B 1/02* (2013.01); *B65B 7/02* (2013.01); *B65B 61/007* (2013.01); *B65B 61/186* (2013.01); *B65D 5/067* (2013.01); *B65D 33/2508* (2013.01); *B65D 47/122* (2013.01); *B65D 77/065* (2013.01); *B65D 77/30* (2013.01); *B65B 2220/18* (2013.01); *B65D 2547/063* (2013.01)

(58) Field of Classification Search

None

See application file for complete search history.

(56) References Cited

U.S. PATENT DOCUMENTS

| | | | |
|---|---|---|---|
| 3,127,082 A | 3/1964 | Meyer-Jagenberg | |
| 4,890,761 A | 1/1990 | Gaves | |
| 5,014,854 A * | 5/1991 | Anderson et al. | 229/214 |

(Continued)

*Primary Examiner* — Viren A Thakur

*Assistant Examiner* — Thanh H Nguyen

(74) *Attorney, Agent, or Firm* — Schmeiser, Olsen & Watts, LLP

(57) ABSTRACT

Disclosed herein is a food box that includes an outer box and an inner bag located within the outer box configured to preserve food contents within the inner bag by preventing air from entering into the inner bag. The cereal box further includes an opening in the inner bag and a cap configured to seal the opening. The cap is attachable and unattachable to the opening. Air is prevented from entering into the inner bag through the opening when the cap is attached. The outer box includes a perforated portion that is removable from the outer box, and when the removable portion is removed, the cap is exposed. Further included herein is a method of forming the food box.

18 Claims, 11 Drawing Sheets

(56) References Cited

U.S. PATENT DOCUMENTS

| | | | | |
|---|---|---|---|---|
| 5,076,493 | A | 12/1991 | Anderson | |
| 6,062,467 | A | 5/2000 | Ours et al. | |
| 6,164,826 | A * | 12/2000 | Petkovsek | 383/210.1 |
| 6,213,388 | B1 | 4/2001 | Ours et al. | |
| 6,349,866 | B1 | 2/2002 | Stewart et al. | |
| 6,386,438 | B1 | 5/2002 | Walsh et al. | |
| 7,097,092 | B1 | 8/2006 | Marrale | |
| 8,328,048 | B2 | 12/2012 | Tschantz et al. | |
| 2003/0085265 | A1 | 5/2003 | Haim | |
| 2004/0007596 | A1* | 1/2004 | Laverdure | 222/212 |
| 2005/0017029 | A1* | 1/2005 | Laverdure | B65D 33/1658 222/490 |
| 2008/0240628 | A1* | 10/2008 | VanLoocke et al. | 383/210 |
| 2008/0279485 | A1* | 11/2008 | Steele | 383/63 |
| 2009/0050682 | A1 | 2/2009 | Cole et al. | |
| 2014/0103101 | A1 | 4/2014 | Alvarado, Jr. | |

* cited by examiner

FOOD CONTAINER AND METHOD

RELATED MATTERS

This Non-Provisional application is a continuation application of and claims priority to U.S. patent Ser. No. 14/587,992, filed Dec. 31, 2014, entitled "Food Container and Method", which claims priority to U.S. Provisional Application Ser. No. 61/922,515, filed Dec. 31, 2013, the disclosures of which are hereby incorporated by reference to the extent that it is consistent with the present application.

FIELD OF THE DISCLOSURE

The subject matter disclosed herein relates generally to food containers. More particularly, the subject matter relates to a fully sealable and resealable cereal box having a resealable opening and method.

BACKGROUND OF THE DISCLOSURE

Food packaging, and more particularly cereal packaging, has been around for decades. It has not changed, and includes an outer box, which is opened from the top by separating two flaps. The flaps are adhered together prior to purchase. Once the top flaps are opened, an internal bag (also sometimes referred to as a "liner") which contains the cereal becomes accessible. The bag is contained within the box and is opened by pulling a top seam or edge apart which was adhered together with heat during packaging. The internal bag may or may not be adhered to the box at the bottom of the box. This type of packaging is also utilized for other types of food including chips, crackers, and the like. It is difficult to prevent air from reaching and turning the food stale within this type of packaging. As such, many consumers prefer to open their cereal and pour it into a fully sealable plastic container and simply throw out the box.

Thus, an improved resealable food container would be well received in the art.

BRIEF DESCRIPTION

According to one embodiment, a food container comprises: an outer box; an inner bag located within the outer box configured to preserve food contents within the inner bag by preventing air from entering into the inner bag; an opening in the inner bag; and a cap configured to seal the opening, wherein the cap is attachable and unattachable to the opening, wherein air is prevented from entering into the inner bag through the opening when the cap is attached; wherein the outer box includes a perforated portion that is removable from the outer box, and wherein when the removable portion is removed, the cap is exposed.

According to another embodiment, a food container comprises: an outer box; an inner bag located within the outer box configured to preserve food contents within the inner bag by preventing air from entering into the inner bag; a first opening in the inner bag; a second opening in the outer box; a cap attached to the first opening in the inner bag, the cap configured to seal the first opening, wherein air is prevented from entering into the inner bag through the opening when the cap is attached, and wherein the cap is exposed through the second opening of the outer box.

According to another embodiment, a method of constructing a food container comprises providing a roll of an inner bag material to a packaging machine, the roll of the inner bag material including a length; attaching a cap to the length of the inner bag material with the packaging machine; enclosing a bottom edge of the length of the inner bag material; filling the length of the inner bag material with food with the packaging machine; enclosing a top edge of the length of the inner bag material to form an enclosed inner bag, wherein the enclosed inner bag is sealed from the exterior environment; and locating the length of the inner bag material within an outer box.

According to another embodiment, a food container comprises: a box filled with pourable food, the box having a sealed gable top having a first gable and a second gable; wherein the gable top includes a resealable zip-top located on an inner surface of the first and second gables.

According to another embodiment, a cereal box comprises: a box filled with cereal, the box not including an inner bag, the box having a sealed gable top having a first gable and a second gable unsealable by pulling the first gable and the second gable apart and pulling a spout out of the first and second gables; wherein the gable top includes a resealable zip-top located on an inner surface of the first and second gables, the resealable zip-top configured to create an air-tight seal in the box.

According to another embodiment, a method of constructing a food container comprises: providing a box; filling the box with a pourable food; fashioning a gable into a top of the box having a first gable and a second gable; sealing the gable; and fashioning a resealable zip-top onto an inner surface of each of the first and second gables.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION

A detailed description of the hereinafter described embodiments of the disclosed apparatus and method are presented herein by way of exemplification and not limitation with reference to the Figures.

Figure 1:
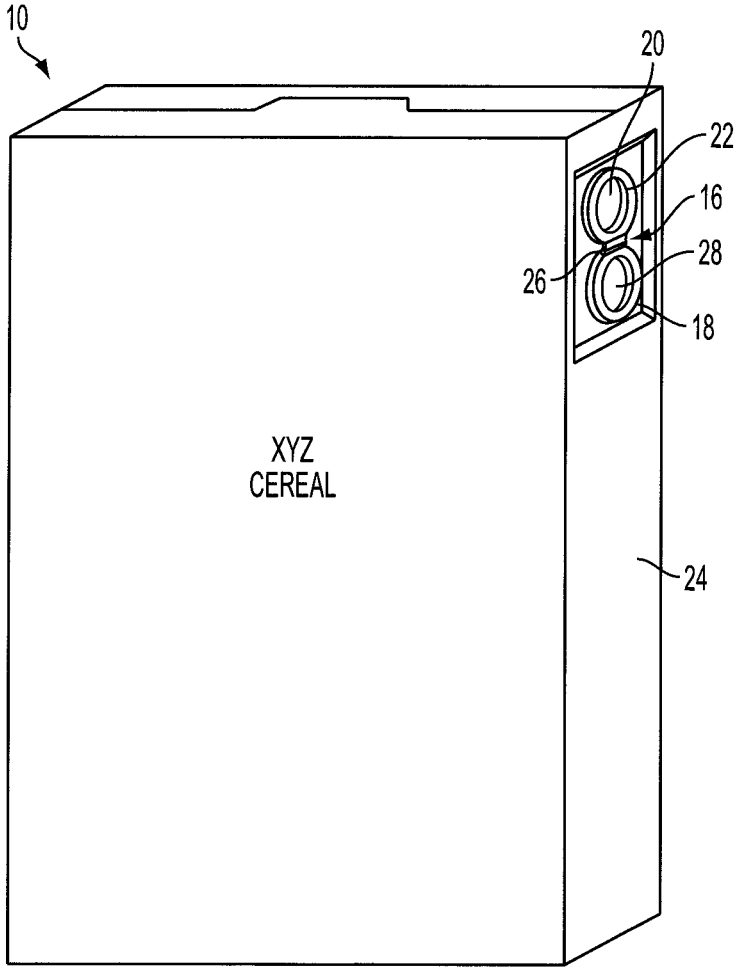
FIG. 1 depicts a perspective view of a food container without an inner bag in accordance with one embodiment.

Referring to FIG. 1, a food container 10 is shown having an outer box 11. The food container 10 along with the other food containers described hereinafter are all shown as a cereal box in the Figures, it should be understood that the food container 10 may house other types of solid food such as crackers, such as Cheese Nips® and Cheez-Its®, chips such as Goldfish® and potato chips, cookies, such as Nilla Wafers®, or the like. Any food which may be meant to be eaten in multiple servings may be housed within the food container 10, and the other food containers described hereinbelow.

The food container 10 may be made primarily from card board in one embodiment. In the embodiment shown, the food container 10 does not include a liner or internal bag. This is because the outer box 11 may act as the liner in that the outer box 11 may ensure that the product maintains its freshness. The outer box 11 may prevent the product from becoming stale both prior to and after purchase by the consumer. Thus, care may be taken during the forming process of the outer box 11 to ensure that the outer box 11 is air tight after receiving the product and after sealing.

Figure 2:
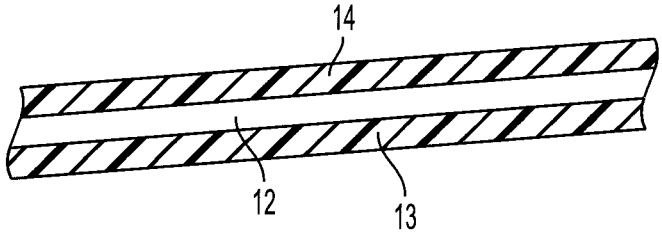
FIG. 2 depicts a cross sectional view of the layers of material that makes up an outer box of the food container of FIG. 1 in accordance with one embodiment.

Referring now to FIG. 2, a cross section of the outer box 11 is shown. The outer box 11 may be made from a paperboard or cardboard layer 12, an inner preservation layer 13 and an outer preservation layer 14. Both the inner and the outer preservation layers 13, 14 may be made from polyethylene, wax or aluminum foil, configured to retain preservation of the food found within. Still further, the inner and outer preservation layers 13, 14 may be made from High Density Polyethylene (HDPE) similar to the material found in prior art linings. Further, the inner and outer preservation layers 13, 14 of the outer box 11 may protect the food to keep an airtight seal in the outer box 11 prior to opening. In manufacturing, the inner preservation layer 13 may be applied to the interior surface of the outer box 11 over the paperboard layer 12 prior to, during, or after the forming or folding of the outer box 11 via a printing, spraying, or any other application process. Similarly, the outer preservation layer 14 may also be applied to the exterior surface of the outer box 11 over the paperboard prior, during, or after the forming or folding of the outer box 11 via a printing, spraying or any other application process. In some cases, the outer box 11 may be partially formed and folded into its shape prior to the application of the inner and outer preservation layers 13, 14. In some embodiments, the inner preservation layer and outer preservation layers 13, 14 may only be applied at the seams of the outer box 11. In this case, the middle paperboard layer 12 may be replaced by a material that is not air permeable. In cases where the middle layer 12 is made from an air permeable material such as paperboard, the entirety of the outer box 11 may be abutted by the inner and outer preservation layers 13, 14 to retain air tight packaging.

Referring back to FIG. 1, the food container 10 may include a resealable opening 16. The resealable opening 16 may be referred to as a cap, lid, cover, or the like. The resealable opening 16 may be made of plastic, in one embodiment. The resealable opening 16 may include a raised outer ring 18. The raised outer ring 18 may be sealed with an accompanying outer flap 20. The raised outer ring may also be referred to as a base upon which the outer flap 20 snaps, locks and/or seals. The outer flap 20 may include its own female corresponding raised outer ring 22 which is configured to snap on to the male raised outer ring 18 which is affixed to the food container 10. The outer rings 18, 22 may thus seal the food container 10 when the flap is connected. However, the resealable opening 16 may be sized to allow a sufficient amount of cereal or other food to be removed from the food container 10 by a consumer during consumption. The opening 16 may be circular, in one embodiment. In other embodiments, the opening 16 may be noncircular in order to facilitate the flow of food product out of the food container 10 depending on the shape of the food product. Still further, the resealable opening 16 is shown at the bottom corner of the outer box 11 on a narrow side 24 of the outer box 11. Thus, the food container 10 may not need to be turned upside down in order to pour the contents out. This may prevent the food product within, for example cereal, from becoming damaged, reducing the occurrence of crumbs created by excessive movement. It should be understood that the opening 16 may be placed at any location in the food container 10. For example, the opening 16 may be placed on a top corner of the narrow side 24 of the outer box 11 in order to simulate the location that cereal, for example, is typically poured out of prior art food containers.

The opening 16 may further include a protective seal layer 28 or layer of plastic and/or metallic or aluminum material which is fully adhered to the opening 16 to seal the opening. The protective seal layer 28 must be pulled off or otherwise removed by a consumer after purchase of the product in order to access the product through the opening 16. The protective seal layer 28 may be utilized in order to prevent tampering with the contents of the food prior to purchase, and may create confidence in the consumer that the product was sufficiently sealed during distribution prior to sale and not tampered with.

The outer flap 20 may be connected to the raised outer ring 18 or the resealable opening 16 with a hinge 26. The hinge 26 may be a plastic hinge which allows the outer flap 20 to remain attached to the cereal box 10 both in an opened and sealed position. Other materials are contemplated such as rubber, or a composite. The hinge 26 and the outer flap 20 and/or the male raised outer ring 18 may further be recessed into the outer box 11, as shown in FIG. 1. This may prevent the opening components 18, 20, 26 from projecting outside of the natural bounds of the outer box 11, and particularly the surface of the side that the opening components 18, 20, 26 are attached to, to allow for the storage and distribution of many stacked food containers 10 from being affected. In other words, the opening components 18, 20, 26 may not protrude from the outer bounds of the outer box 10 thereby retaining the same or similar maximum outer dimensions of prior art food containers such as cereal boxes.

Figure 3:
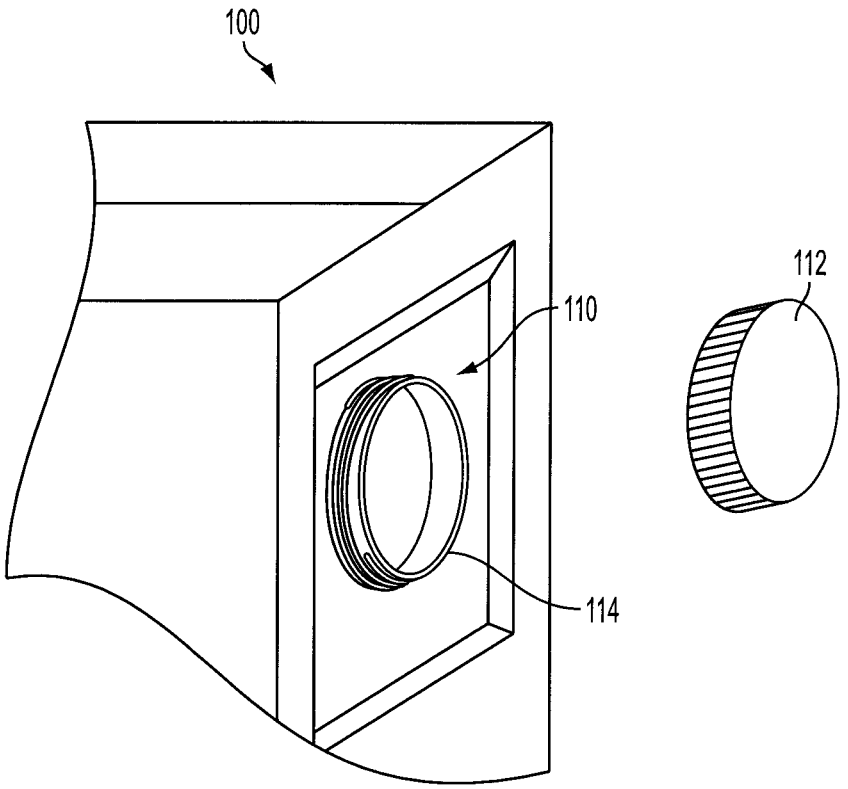
FIG. 3 depicts a perspective view of another food container in accordance with one embodiment.

In another embodiment shown in FIG. 3, a food container 100 may be similar to the food container 10 described hereinabove. However, the food container 100 may include a threaded cap opening 110, rather than the foldable flap opening 16. The threaded cap opening 110 may include a threaded female cap 112 and a threaded male base 114. The threaded male base 114 may be integrated into the food container 100 to retain a seal when the female cap 112 is applied thereto. Like the previous embodiment, a protective seal layer (not shown) may be included within the male base 114 prior to the consumer opening the box. Further, similar to the food container 10 described hereinabove, the threaded cap opening 110 may be housed within a recess of the cardboard box.

Figure 4:
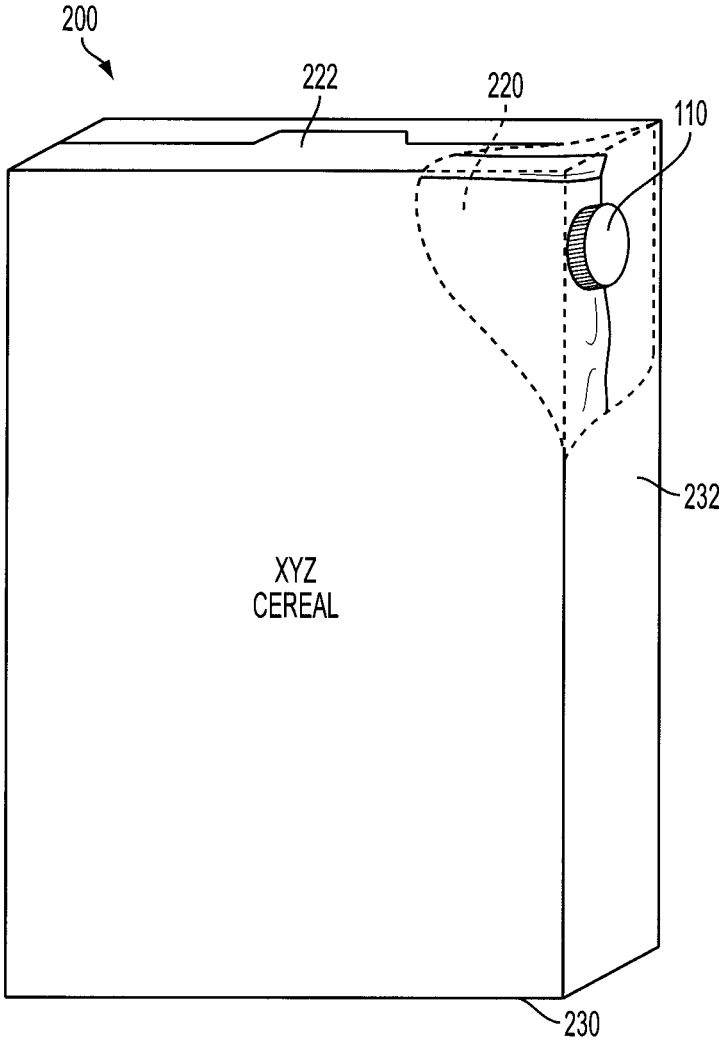
FIG. 4 depicts a cutaway view of another food container having an inner lining in accordance with one embodiment.

As shown in FIG. 4, another food container 200 is shown having an inner bag 220 and an outer paperboard box 222. The inner bag 220 or lining is included in this embodiment, rather than, for example, the inner and outer preservation layers, 13, 14 described hereinabove. However, it should be understood that the preservation layers 13, 14 may be included in this embodiment as well. This inner lining 220 may include one of the threaded cap opening 110 or the cap opening 16, or another sealable opening. Shown in this particular embodiment of FIG. 4, however, is the threaded cap opening 110. Rather than being attached to the box, however, the threaded cap opening 110 or the cap opening 16 may be attached to the inner lining 220 instead. In this embodiment, the cap opening 110 may be exposed outside of the outer box 222 after packaging and when the food container 200 is on the shelf at the point of sale. As described hereinabove, the cap 110 may include a protective seal layer that may be removable by a consumer to unseal the box and allow for a consumer to access the contents therein. Furthermore, in this embodiment, the inner bag 220 may be adhered or attached to a bottom surface 230 of the interior (not shown) of the outer box 222. Additionally, the inner bag 220 may be adhered to a side surface 232 of the interior of the outer box 222.

To fashion the food container 200, the inner bag 220 may be first supplied to a packaging machine either before or after being filled with food product. The bag 220 may then be adhered, with heat or an adhesive or otherwise, to the bottom surface 230 of the interior of the outer box 222. Similarly, the bag 220 may be adhered, with heat or an adhesive or otherwise, to the side surface 232 of the interior of the outer box 222. With the bag 220 adhered to the side surface 232 of the outer box 222, another heat or cutting process may be exacted on the food container 200 by the packaging machine. In one embodiment, a cut may be made with a sharp or heated blade into the side surface 232 and the inner bag 220 simultaneously or one after the other. Once the opening has been fashioned, the cap 110 may be inserted into the opening. In one embodiment, the heat from heated blade that makes the cut also heats the inner bag 220 so that it remains melted when the cap 110 is applied. Thus, when the cap 110 is applied in this manner, the residual heat from the inner bag 220 may melt the bag to the cap 110 thereby creating a seal. In other embodiments, exterior edges of the cap 110 may be heated prior to application into the opening to further melt the inner bag 220 to the cap to create a seal. It should be understood that the same process could be applied to attaching a flap style cap such as the foldable flap opening cap 16.

Figure 5:
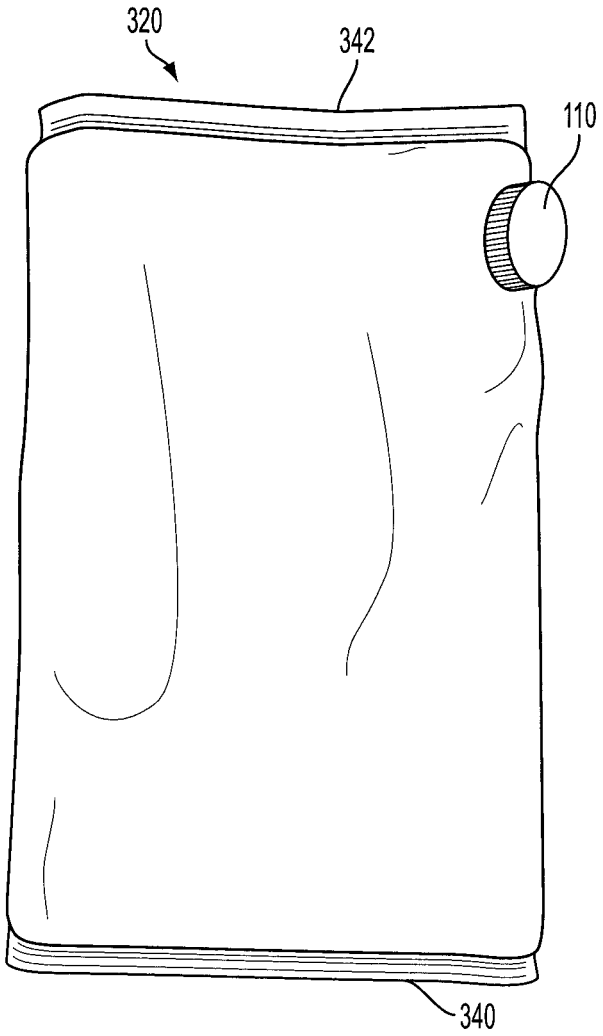
FIG. 5 depicts an inner lining of another food container in accordance with one embodiment.
Figure 6:
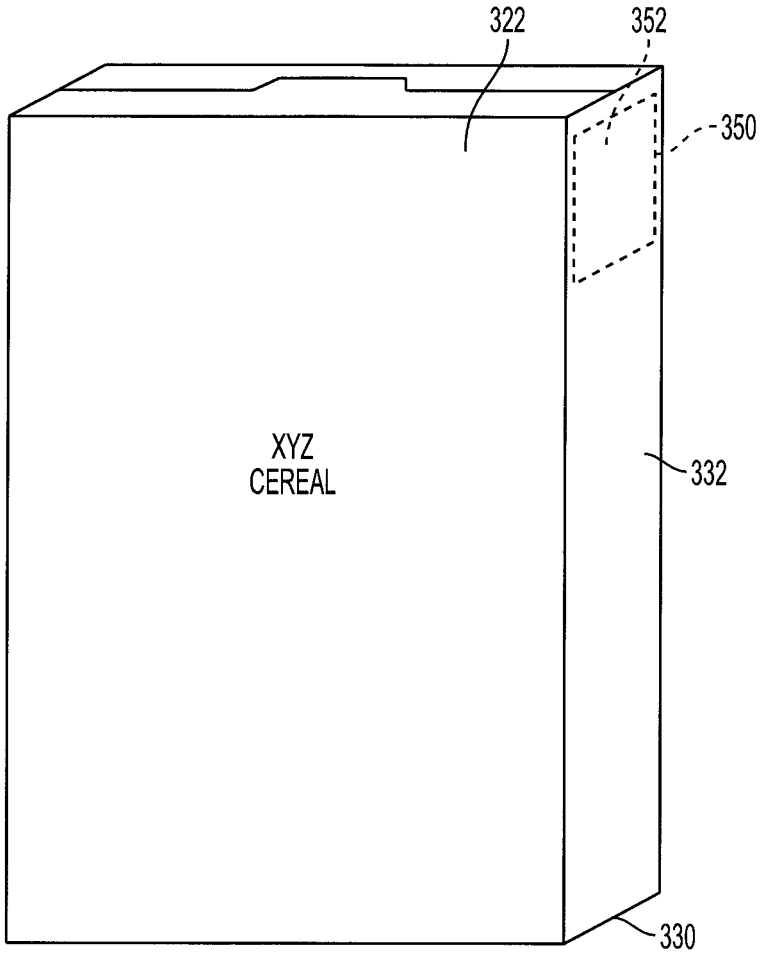
FIG. 6 depicts a box configured to house the inner lining of FIG. 5 in accordance with one embodiment.
Figure 7:
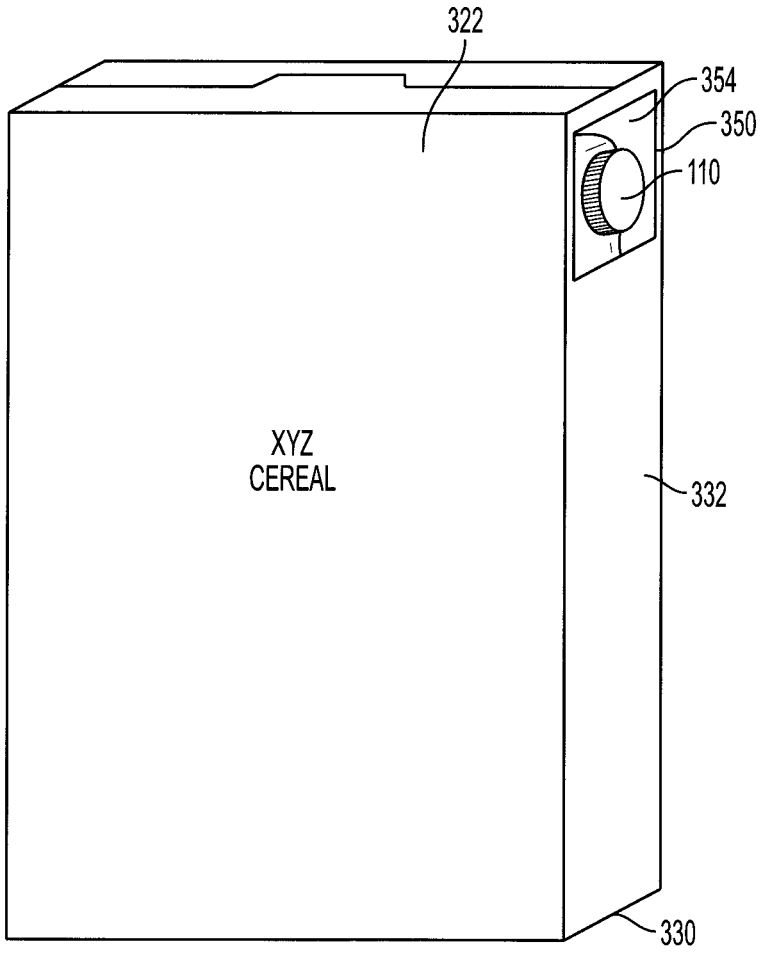
FIG. 7 depicts the box and inner lining of FIGS. 5 and 6 in accordance with one embodiment.

Referring now to FIGS. 5-7, another embodiment is shown of a food container 300. In particular, FIG. 5 shows a perspective view of an inner bag 320 of the food container 300. In this embodiment, the cap 110 is applied to the inner bag 220 prior to the inner bag 220 being inserted or attached to an outer box 322. As described hereinabove, the cap 110 in this embodiment may be any type of resealable component. The cap 110 is not attached to the outer box 322 in this embodiment. Furthermore, as shown in FIG. 6, the outer box 332 may include perforations 350 surrounding a perforated portion 352. The perforated portion 352 may be removable by a consumer. As shown in FIG. 7, the perforated portion 352 has been removed, exposing the cap 110 through an opening 354. The perforated portion 352 and perforations 350 are shown on a side surface 332 proximate a top surface 334. However, in other embodiments (not shown), the perforated portion 352 and perforations 350 may be located on the side surface 332 proximate a bottom surface 330. Other locations of the perforated portion 352 are contemplated. However, whatever the embodiment, the location of the perforations 350 and the perforated portion 352 may be located proximate the cap 110 located on the inside of the outer box 322 such that removable of the perforated portion 352 exposes the cap 110. Still further, in other embodiments, the perforated portion 352 may be particularly sized in order to receive the cap 110 in a more permanent manner. For example, the cap 110 may be configured to slide into the opening 354 created by the removable of the perforated portion 352. This may be configured to hold the cap 110 in place within the opening 354.

Figure 11:
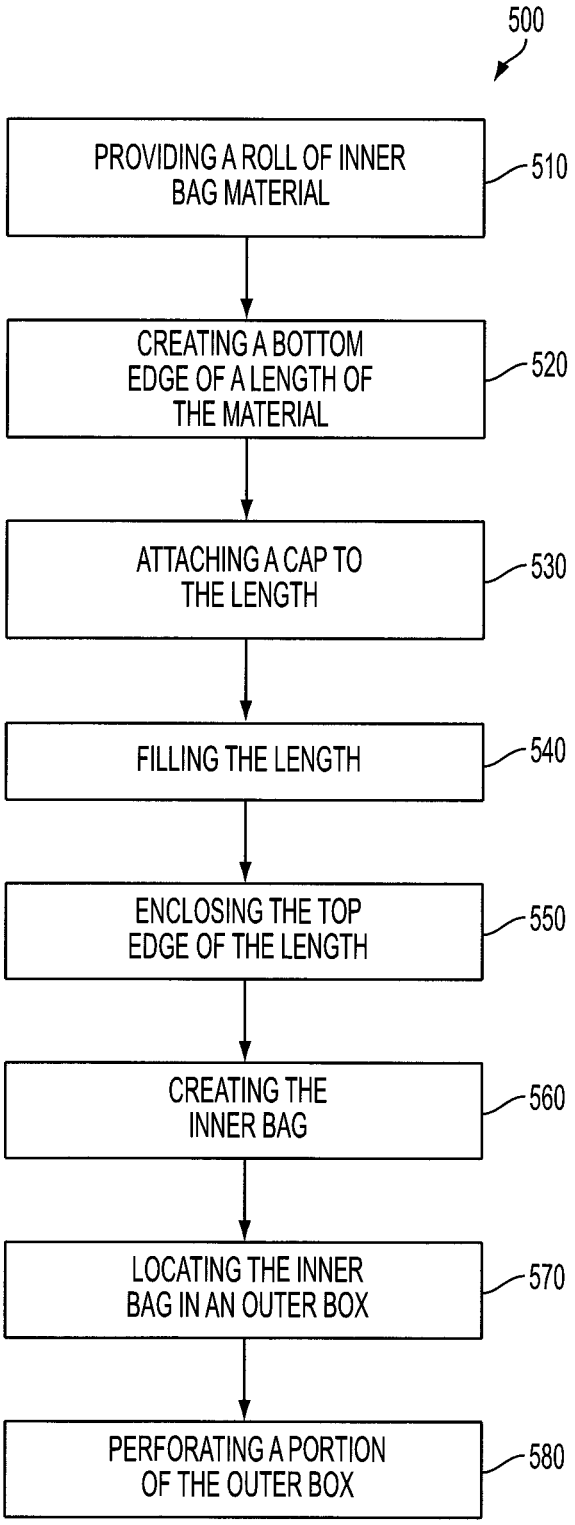
FIG. 11 depicts a schematic view of a method of creating the food container of FIGS. 5-8 in accordance with one embodiment.

In one embodiment, a method 500 of creating the food box 300 is contemplated, as shown in FIG. 11. In the method, the inner bag 320 may be a length of material found on a roll of inner bag material (not shown). This roll of inner bag material may be provided at a first step 510. The packaging machine may create the inner bag by first separating lengths, one at a time, from the rest of the roll in some manner, for example, by heat pressing the roll together to form a bottom edge and thereafter cutting this edge away from the rest of the roll, at a step 520. Either before or after the length of the inner bag material has been separated in some manner from the greater length provided by the entire roll of the lining material, the packaging machine may attach the cap 110 to the inner bag material length, at a step 530. In one embodiment, the cap 110 may be attached proximate the bottom edge 340 of the inner bag 320. In other embodiments, the cap 110 may be attached at other locations such as at the top edge 342 of the inner bag 320. The packaging machine may also be configured to cut or melt the inner bag 320 at some point in the process prior to application of the cap 110 in order to fashion an opening in the inner bag 320 to thereafter attach the cap 110. In one embodiment, the heat applied by melting the opening into the inner bag 320 may be utilized to also melt the material of the inner bag 320 to an outer edge of the cap 110, thereby sealing the cap 110 in an airtight manner. In other embodiments, the packaging machine may heat press the edge of the opening of the length of the plastic film material or inner bag 320 to the cap 110 to seal the opening to the cap 110. Once the cap 110 has been applied to the inner bag 320, the inner bag 320 may be filled with food such as cereal, at a step 540. This filling may occur before or after the inner bag 320 is placed into the outer box 322. Once filled with the food, the inner bag 320 may be enclosed at the top edge 342 in a similar manner to the bottom edge 340 (e.g. by heat pressing), at a step 550. This may create a fully sealed (from the external embodiment) inner bag 320, at a step 560. Once the packaging machine places the inner bag 320 into the outer box 322, at a step 570, the bottom edge 340 of the inner bag 320 may be attached or adhered to the interior bottom surface 330 of the outer box 322. Either before or after the inner bag 320 is placed into the outer box 322, the packaging machine could apply the perforation 350 to the outer box 322 along a side surface 332, either proximate a top or bottom of the outer box 322, at a step 580. The location of the perforation 350 may be proximate to the cap 110 located on the inner bag 320 such that when the perforated portion 352 is removed the cap 110 is exposed and may be pulled out of the opening created by the removed perforated portion 352.

Figure 8:
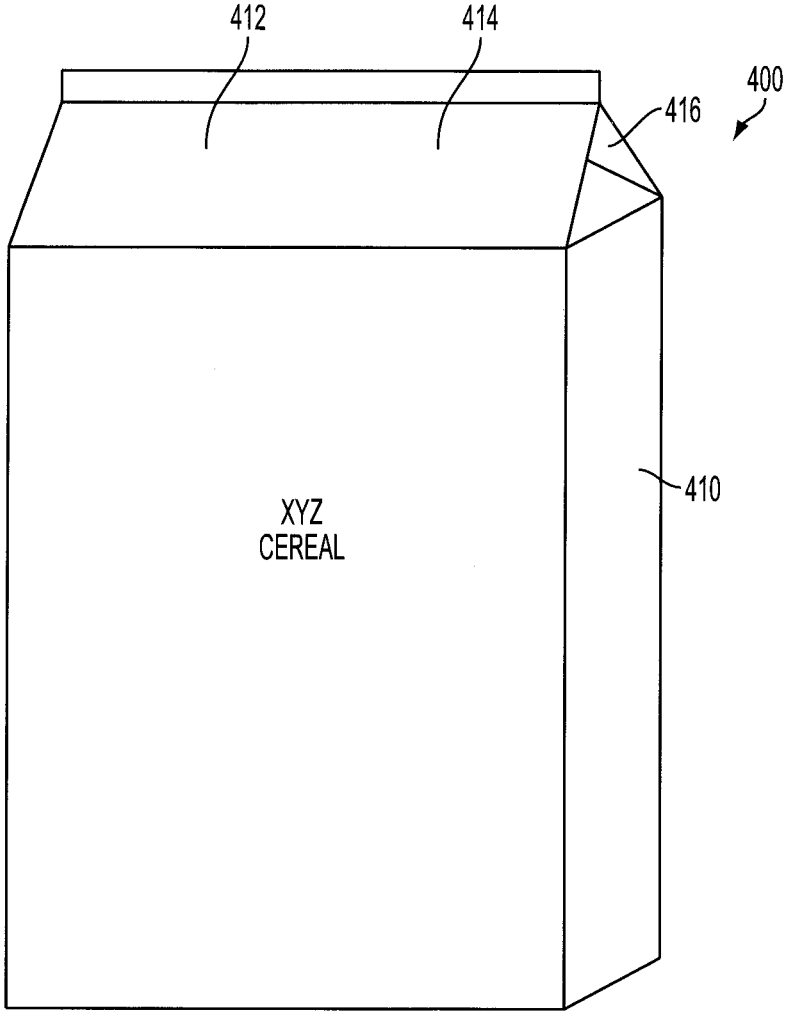
FIG. 8 depicts a perspective view of the food container with a gable top in accordance with one embodiment.
Figure 9:
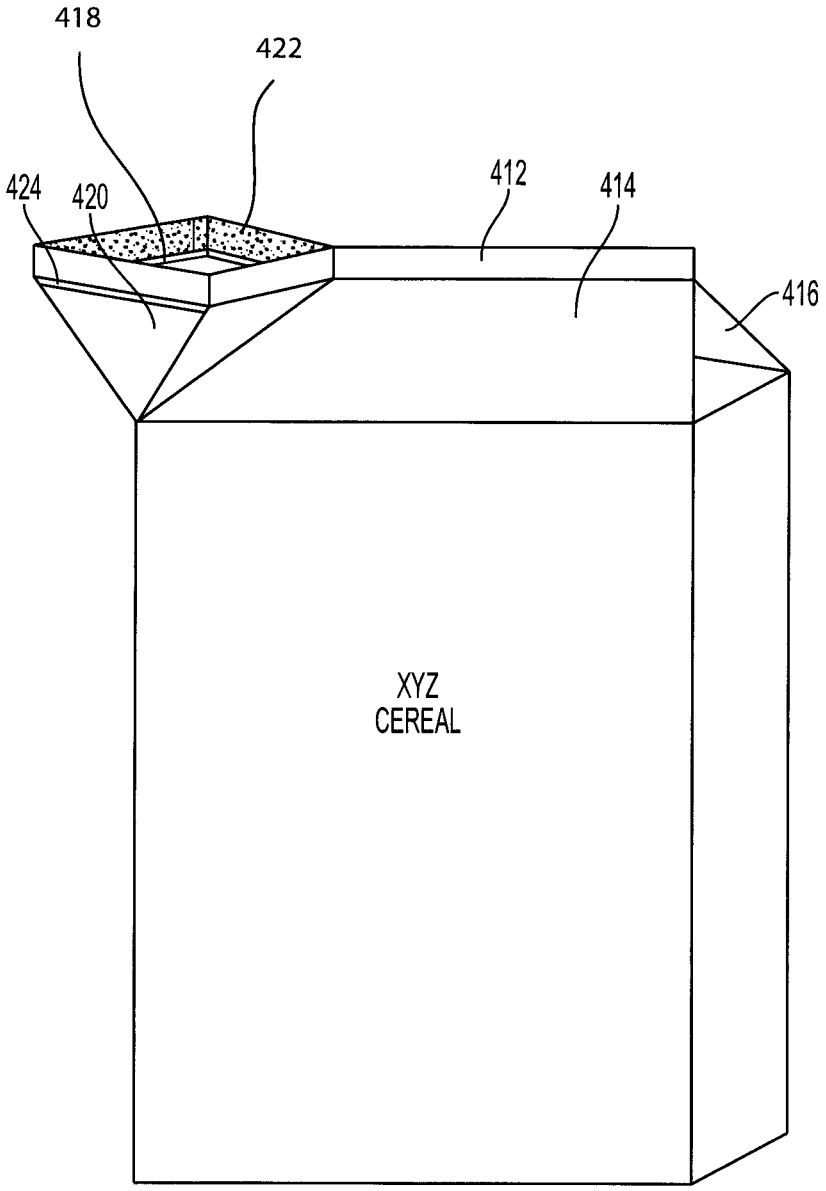
FIG. 9 depicts another perceptive view of the food container of FIG. 8 after opening the gable top to reveal a spout in accordance with one embodiment.

Still another embodiment is shown in FIGS. 8-10 of a food container 400. The food container 400 may include an outer box 410 which may be filled with a pourable food such as cereal. The outer box 410 may include a sealed gable top 412 as shown in FIG. 8 having a first gable 414 and a second gable 416. The gable top 412 further includes a resealable zip-top 418 located on an inner surface of the first and second gables 414, 416. The resealable zip-top 418 may be a zip-lock seal, or any similar airtight compressible zipper or the like. The gable top 412 may further be unsealed by pulling open the first gable 414 and the second gable 416 half way along an entire width of the sealed gable top 412 and pulling a spout 420 out of the first and second gables 414, 416, as shown in FIG. 9. This embodiment may not include an inner lining or bag in the food container. Rather, the food container 400 may include an outer polyethylene layer, a middle paperboard layer, and an inner polyethylene layer to keep the box sealed prior to opening the sealed gable top 412. In the embodiment shown in FIG. 9, the resealable zip-top 418 may be located below a broken seal 422 of the previously sealed gable top 412. In other embodiments (not shown), the resealable zip-top 418 may be located above the broken seal 422 of the previously sealed gable top 412.

Moreover, the gable top 412 of this embodiment may be replaced with other style tops. However, in any embodiment, the concept of applying a zip-top style sealing onto a paperboard or cardboard box that has been opened is contemplated. Further, it is contemplated that the paperboard box would first be unsealable by breaking an adhesive. This unsealing or opening of the box would then reveal the resealable zip top sealing zipper.

Figure 10A:
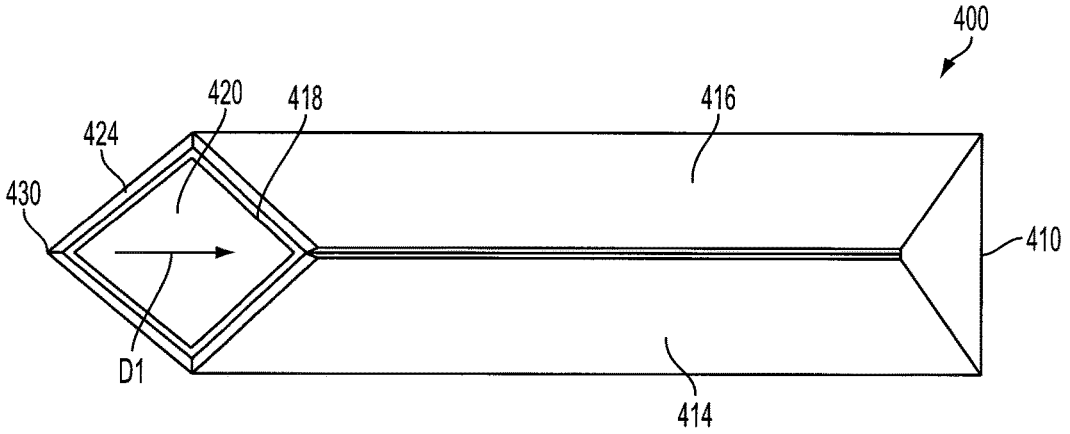
FIG. 10A depicts a top view of an opened food container in accordance with one embodiment.
Figure 10B:
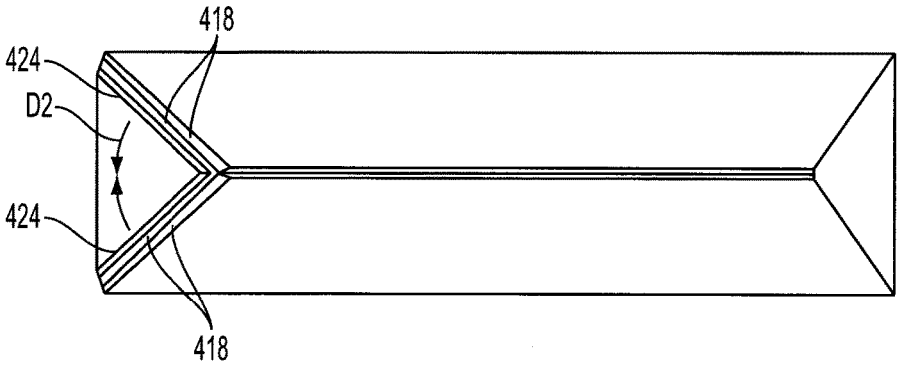
FIG. 10B depicts a top view of an opened food container in accordance with one embodiment.

Furthermore, as shown in FIGS. 9-10B, the spout 420 may further include a second outer resealable zip-top 424 located on an outer or exterior surface of the spout 420 of the first and second gables 414, 416. As shown in FIG. 10A, both the exterior surface of the spout 420 and the interior surface of the spout 420 include the resealable zip-tops 424, 418. The resealable zip-tops 424, 418 may in combination create a fully air tight seal within the food container 400 when both are zipped closed. To close the zippers of the zip-tops 424, the spout may be pulled back to its original state prior to breaking the original seal 422. As shown in FIG. 10A, to close the zip-tops 418, a tip 430 of the spout 420 may first be pressed together in the direction D1. This may place the interior zip tops 418 in an adjacent relationship where they can be compressed together forming a seal. Next, as shown in FIG. 10B, the gables 414, 416 may be moved in the direction D2, thereby placing the exterior zip tops 424 in an adjacent relationship where they can be compressed together forming another seal. Again, this combination of zip-tops 418, 424 may create an airtight seal. In other embodiments, only the interior zip-tops 418 may be necessary.

In yet another embodiment, a method of constructing a food container is contemplated. The method may include first providing a box, such as the box 410. The method may include filing the box with a pourable food and fashioning a gable into a top of the box, such as the gable 412. The gable may include a first and a second gable, such as the first and second gables 414, 416. The method may include sealing the gable, for example, with the original seal 422. The method may further include fashioning a resealable zip-top, such as the zip-tops 424, 418, onto an inner surface of each of the first and second gables. The method may further include unsealing the gable by pulling open the first gable and the second gable half way along an entire width of the sealed gable and pulling a spout, such as the spout 420, out of the first and second gables. The method may further include layering an outer polyethylene layer, a middle paperboard layer, and an inner polyethylene layer to create the box. The method may still further include heat pressing the first and second gable together to seal the gable. Moreover, the method may include fashioning the resealable zip-top above a seal of the sealed gable top. The method still further may include fashioning the resealable zip-top below a seal of the sealed gable top. The method may also include zipping the zip top closed and creating an air tight seal by the zip-top within the food container. The method may still further include fashioning a resealable zip-top onto an outer surface of the spout.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

I claim:

1. A food container comprising:

a box filled with pourable food, the box having a sealed gable top having a first gable and a second gable;

wherein the gable top is configured to be unsealed by pulling open the first gable and the second gable half way along an entire width of the sealed gable top and pulling a spout out of the first and second gables, and wherein the spout includes a resealable zip-top located on an inner surface of the first and second gables.

2. The food container of claim 1, wherein the box comprises an outer polyethylene layer, a middle paperboard layer, and an inner polyethylene layer to keep the box sealed prior to opening the sealed gable top.

3. The food container of claim 1, wherein the pourable food is cereal.

4. The food container of claim 1, wherein the resealable zip-top is located above a seal of the sealed gable top.

5. The food container of claim 1, wherein the resealable zip-top is located below a seal of the sealed gable top.

6. The food container of claim 1, further comprising a second zip-top located on an exterior surface of the spout of the first and second gables.

7. The food container of claim 1, wherein the resealable zip-top creates an air tight seal within the food container when zipped.

8. A cereal box comprising:

a box filled with cereal, the box not including an inner bag, the box having a sealed gable top having a first gable and a second gable unsealable by pulling the first gable and the second gable apart and pulling a spout out of the first and second gables;

wherein the gable top is configured to be unsealed by pulling open the first gable and the second gable half way along an entire width of the sealed gable top and pulling a spout out of the first and second gables, and wherein the spout includes a resealable zip-top located on an inner surface of the first and second gables, the resealable zip-top configured to create an air-tight seal in the box.

9. The cereal box of claim 8, further comprising a second zip-top located on an exterior surface of the spout of the first and second gables.

10. The cereal box of claim 8, wherein the resealable zip-top is located below a seal of the sealed gable top.

11. A method of constructing a food container comprising:

providing a box;

filling the box with a pourable food;

fashioning a gable into a top of the box having a first gable and a second gable;

sealing the gable; and fashioning a resealable zip-top onto an inner surface of each of the first and second gables;

unsealing the gable by pulling open the first gable and the second gable half way along an entire width of the sealed gable;

pulling a spout out of the first and second gables wherein the resealable zip-top is fashioned onto an interior of the spout.

12. The method of claim 11, further comprising layering an outer polyethylene layer, a middle paperboard layer, and an inner polyethylene layer to create the box.

13. The method of claim 11, wherein the pourable food is cereal.

14. The method of claim 11, further comprising heat pressing the first and second gable together to seal the gable.

15. The method of claim 11, further comprising fashioning the resealable zip-top above a seal of the sealed gable top.

16. The method of claim 11, further comprising fashioning the resealable zip-top below a seal of the sealed gable top.

17. The method of claim 11, further comprising zipping the zip top closed and creating an air tight seal by the zip-top within the food container.

18. The method of claim 11, further comprising fashioning a second resealable zip-top onto an outer surface of the spout.

* * * * *